United States Patent [19]

Bachellerie

[11] Patent Number: 5,069,606

[45] Date of Patent: Dec. 3, 1991

[54] ROTARY FLUID DISPLACEMENT APPARATUS

[76] Inventor: John R. Bachellerie, 2150 Forbestown Rd., Oroville, Calif. 95966

[21] Appl. No.: 597,531

[22] Filed: Oct. 15, 1990

[51] Int. Cl.[5] ..... F04C 1/16

[52] U.S. Cl. ..... 418/58; 73/864.34; 418/205

[58] Field of Search ..... 73/863.73, 864.34; 418/9, 10, 58, 200, 205

[56] References Cited

U.S. PATENT DOCUMENTS

| | | | |
|---|---|---|---|
| 178,672 | 6/1876 | Reynolds | 418/206 |
| 2,919,062 | 12/1959 | Tryhorn | 418/161 |
| 3,121,530 | 2/1964 | Lorenz | 418/9 |
| 3,653,791 | 4/1972 | McCoy | 418/205 |
| 3,728,049 | 4/1973 | Miller, Jr. | 418/58 |
| 3,810,723 | 5/1974 | Johnson | 418/205 |

FOREIGN PATENT DOCUMENTS

| | | | |
|---|---|---|---|
| 629654 | 3/1936 | Fed. Rep. of Germany | 418/200 |

OTHER PUBLICATIONS

Magazine: "Mechanisms, Linkages and Mechanical Controls"-Author: S. Rappaport-Title: Two-Tooth Gear Systems-p. 247, Publisher—: McGraw-Hill Book Company.

*Primary Examiner*—Richard A. Bertsch

*Assistant Examiner*—David L. Cavanaugh

[57] ABSTRACT

Two essentially identical oval shaped blades each attached rotatably by axles within a cylindrically shaped main chamber of a housing. Each blade has a cross-sectional profile approximating opposing larger radius 90 degree arcs connected by opposing smaller radius 90 degree arcs. Each blade is attached to a rotatable carriage assembly within the housing, and 180 degrees apart in the same orbital path about the rotational axis of the carriage assembly. The rotational axis of the carriage assembly, and the orbital path of the blades about the carriage assembly axis are eccentric relative to the center of the main chamber. A transmission and timing arrangement communicates and coordinates rotational movement between the carriage assembly and blades. The blades are positioned with the length of one blade perpendicular to the other blade length while rotating and orbiting about the axis of the rotating carriage assembly. The maintained perpendicularity between the lengths of the two blades provides continuous close proximity of one blade to the other. As the blades rotate in the same direction and velocity, and orbit about the axis of the rotating carriage assembly, the blades assist in defining expanding and contracting sub-chambers within the main chamber. A fluid input port through the housing is positioned in communication with expanding sub-chambers, and a fluid output port through the housing is positioned in communication with contracting sub-chambers.

6 Claims, 12 Drawing Sheets

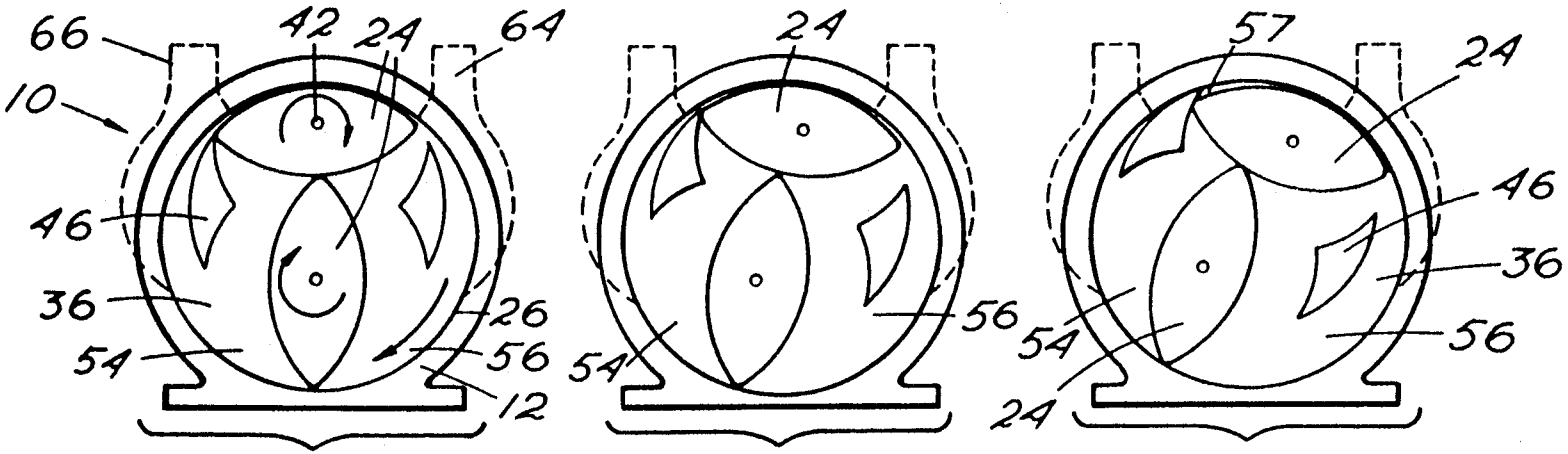
FIG. 8A
FIG. 8B
FIG. 8C
FIG. 8D
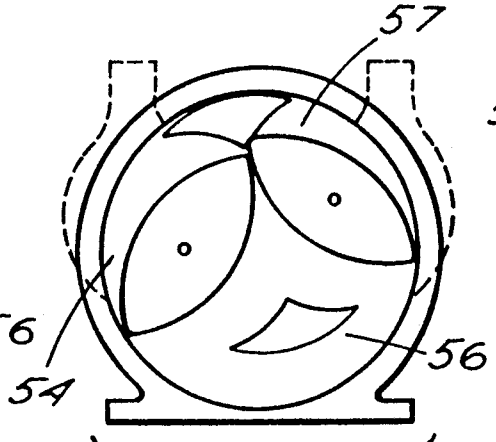
FIG. 8E
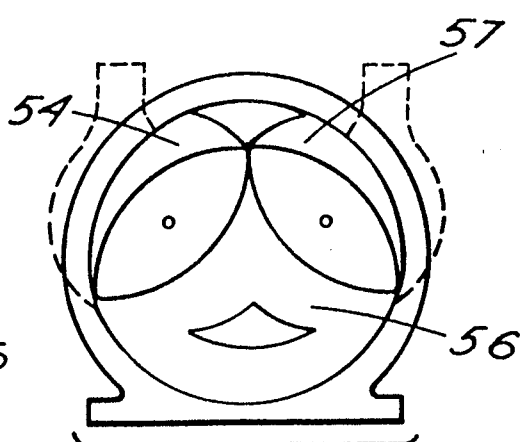
FIG. 8F

ROTARY FLUID DISPLACEMENT APPARATUS

BACKGROUND OF THE INVENTION

1. Field of the Invention

This invention relates to a rotary fluid displacement apparatus which may use applied rotary energy to pump a fluid such as a gas or liquid, or may utilize impetus from gas or liquid applied under pressure to supply rotary energy. In other words this invention relates to both a rotary fluid pump or gas compressor, and a fluid or gas pressure driven rotary motor or engine.

2. Description of the prior art

Numerous rotary fluid-mechanical and mechanical-fluid energy translation machines have been developed in the past. An "Information Disclosure Statement" is filed herewith, in which pertinent past art devices are discussed. No past art devices are seen to be structured as the invention of this disclosure.

SUMMARY OF THE INVENTION

The invention of this disclosure incorporates the advantages of rotary component movement and continuous fluid flow in an apparatus which is useful for both pumping a fluid, and using a fluid applied under pressure to supply rotary energy to accomplish work. For the purpose of this disclosure, the term "fluid" refers to any flowable material including gases and liquids.

My apparatus is quite efficient, having a relatively high fluid flow rate per revolution of the rotary components of the structure, thereby reducing wear on the moving parts relative to a given volume of fluid moved. Other advantages of my invention are relative low cost and ease of manufacture of components due to the use of relatively easily machinable shapes, and the inherently dynamic balance of the rotary components of the preferred structure of the invention.

My invention utilizes two essentially identical rotatable blades contained within a cylindrically shaped main chamber of a housing. Each blade is roughly oval in cross-sectional profile, and desirably has an cross-sectional profile approximating opposing equal larger radius 90 degree arcs endwardly connected by opposing equal smaller radius 90 degree arcs at narrowed ends of the blades. The preferred blade shape using 90 degree arcs is relatively easily machined or formed into molds for casting, and is also a shape which simplifies the formation of moving fluid seals.

Each blade is rotatably attached centrally by an axle to a rotatably retained carriage assembly within the housing. The blades are positioned to have the cross-sectional longitudinal axis of one blade perpendicular to the other blade cross-sectional longitudinal axis at all times. The rotational axis of each blade is placed equally distant outward from the rotational axis of the rotatable carriage assembly, in the same orbital path about the rotational axis of the carriage assembly, and placed 180 degrees apart from the rotational axis of the other blade during operation of the apparatus. The rotational axis of the carriage assembly, and therefore the orbital path of the blades is eccentrically placed relative to an interior annular sidewall of the housing which assists in defining the main chamber. Since the two identical blades are attached centrally by axles, and in the same orbital path about the rotational axis of the carriage assembly, in theory, if the blades and carriage assembly are properly manufactured, my apparatus should be inherently dynamically balanced.

A mechanical transmission and timing arrangement is utilized to communicate and coordinate rotational movement between the blades and the carriage assembly. During operation, while the blades orbit about the rotational axis of the rotating carriage assembly, each blade rotates in the same direction and velocity about the blade rotational axis as the other blade, and at a rate equal to one-half revolution per one full revolution of the rotating carriage assembly. The perpendicularity between the lengths of the two blades is maintained during rotation, allowing contact or continuous close proximity to contact of one blade to the other at all times. The maintained perpendicular relationship of one blade to the other allows the formation and maintenance of a fluid seal between the two blades at the point of contact or approximate contact. The orbital path of the rotating blades within the main chamber allows a maintained contact or approximate contact of each blade with the interior annular sidewall of the main chamber.

As the blades rotate, and orbit about the rotational axis of the rotating carriage assembly, the blades serve as continuously moving partitions, assisting in defining expanding and contracting rotating sub-chambers within the main chamber.

With the attachment of two seal blocks to the carriage assembly within the main chamber, greatly improved separation between the expanding and contracting sub-chambers may be accomplished, allowing my apparatus to function with high efficiency as a rotary positive fluid displacement apparatus.

During rotational orbit about the rotational axis of the carriage assembly, each blade and each seal block rotates towards and then away from the interior annular sidewall of the main chamber due to the eccentric placement of the rotational axis of the carriage assembly within the main chamber. A fluid input port through the housing is positioned in communication with expanding sub-chambers, and a fluid output port through the housing is in communication with contracting sub-chambers for intaking and exhausting a supply of fluid.

During operation, the expanding and contracting sub-chambers work to intake and then exhaust a working fluid. If a fluid is applied with pressure into the main chamber through the fluid input port, the blades and carriage assembly are forced to rotate and to apply rotary energy to a main shaft or other similar output device of the apparatus. The main shaft is connected at the rotational axis of the carriage assembly, and extends to the exterior of the apparatus where the rotary energy therein may be harnessed.

The expanding and contracting sub-chambers of the apparatus may be utilized to pump a liquid or gas when rotary energy is applied to the main shaft, such as by an electric motor for example. When rotary energy is applied to the main shaft, the blades and carriage assembly rotate, with the expanding sub-chambers working to intake a fluid through the fluid input port. The fluid filled expanding sub-chambers are then rotated around toward the fluid exhaust port and begin to become contracting sub-chambers to exhaust the fluid simultaneously as other sub-chambers are expanding to intake additional fluid.

Therefore a primary object of my invention is to provide an improved rotary fluid displacement apparatus which is useful for either pumping a fluid, or using a fluid applied under pressure to rotate a main shaft of the apparatus.

A further object of my invention is to provide the above in an apparatus which can be manufactured inexpensively and accurately due to the use of relatively easily manufactured shapes.

A still further object of my invention is to provide the above in an apparatus which is structured in a manner which inherently provides dynamic balance of the rotary components of the structure.

An even still further object of my invention is to provide the above in an apparatus which is dynamically balanced, has a high fluid flow rate per revolution of the rotary components of the structure, and is therefore capable of operating at relatively low revolutions per minute to provide a durable, low maintenance apparatus.

Further objects and advantages of my structure will be understood with a continued reading of the specification coupled with an examination of my appended drawings.

BRIEF DESCRIPTION OF THE DRAWINGS

FIG. 8A through 8K depicts the different positions of two blade profiles as they travel through one-half revolution of the carriage assembly of the apparatus.

BEST MODE FOR CARRYING OUT THE INVENTION

Figure 12:
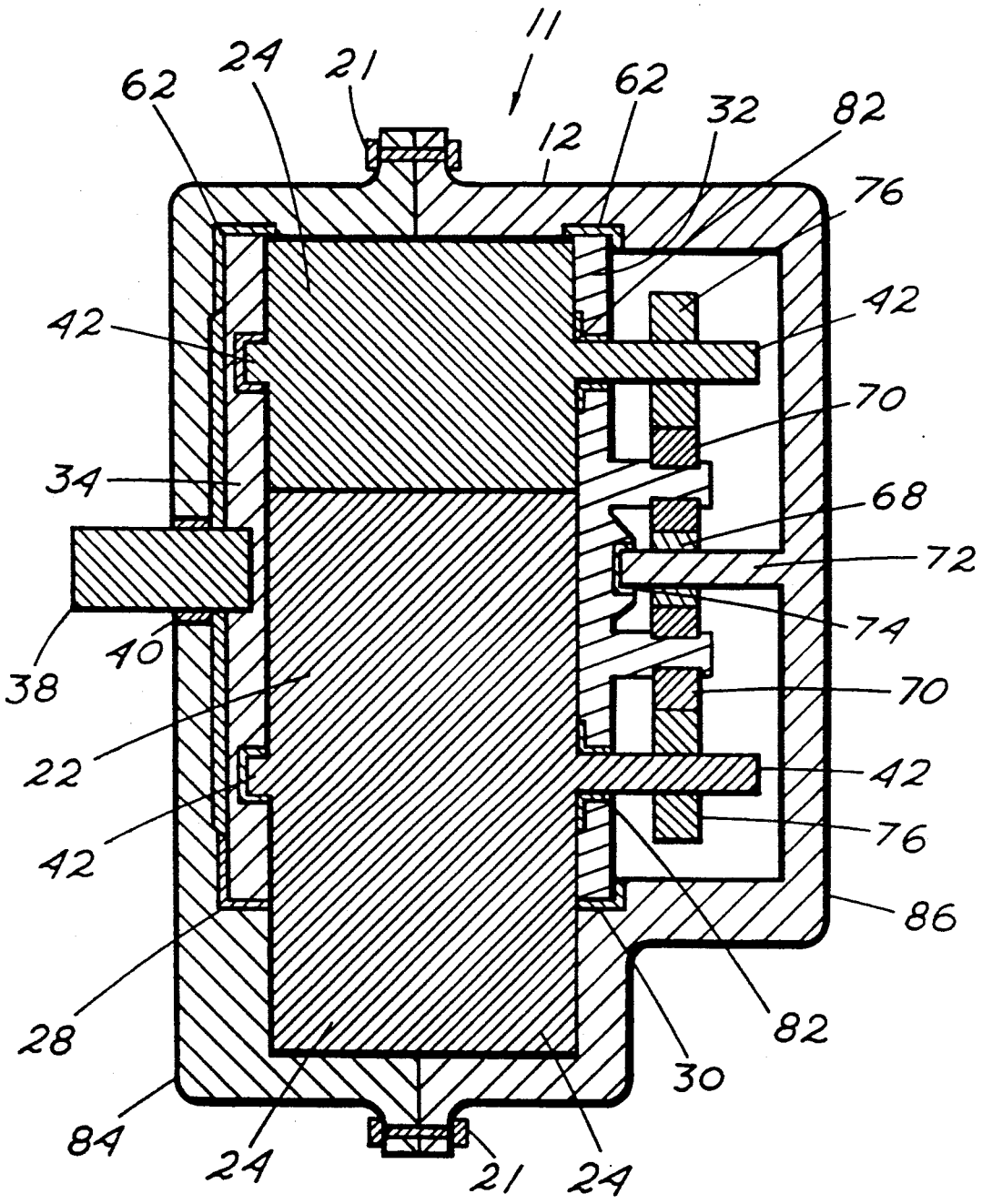
FIG. 12 is a partially sectioned illustrative side view of a slightly varied structural embodiment of the invention from that shown in FIG. 1 through 6.

It should be understood that the invention is susceptible of embodiment in many and various forms, some of which are illustrated in the accompanying drawings, and that the structural details herein set forth may be varied to suit particular purposes and still remain within the inventive concept. Referring now primarily to drawing FIGS. 1 through 10 where a specific structural embodiment of the invention and components thereof are illustrated for example. The embodiment of the invention shown in FIG. 1 through 6 is generally designated embodiment 10. A second structural example of the invention, being a slight variation of that shown in embodiment 10, is shown in cross section in FIG. 12. The embodiment shown in FIG. 12 is designated by the number 11, and differs only slightly in actual physical structuring compared to embodiment 10. The differences between embodiments 10 and 11 will be described in greater detail after the description of embodiment 10.

Figure 1:
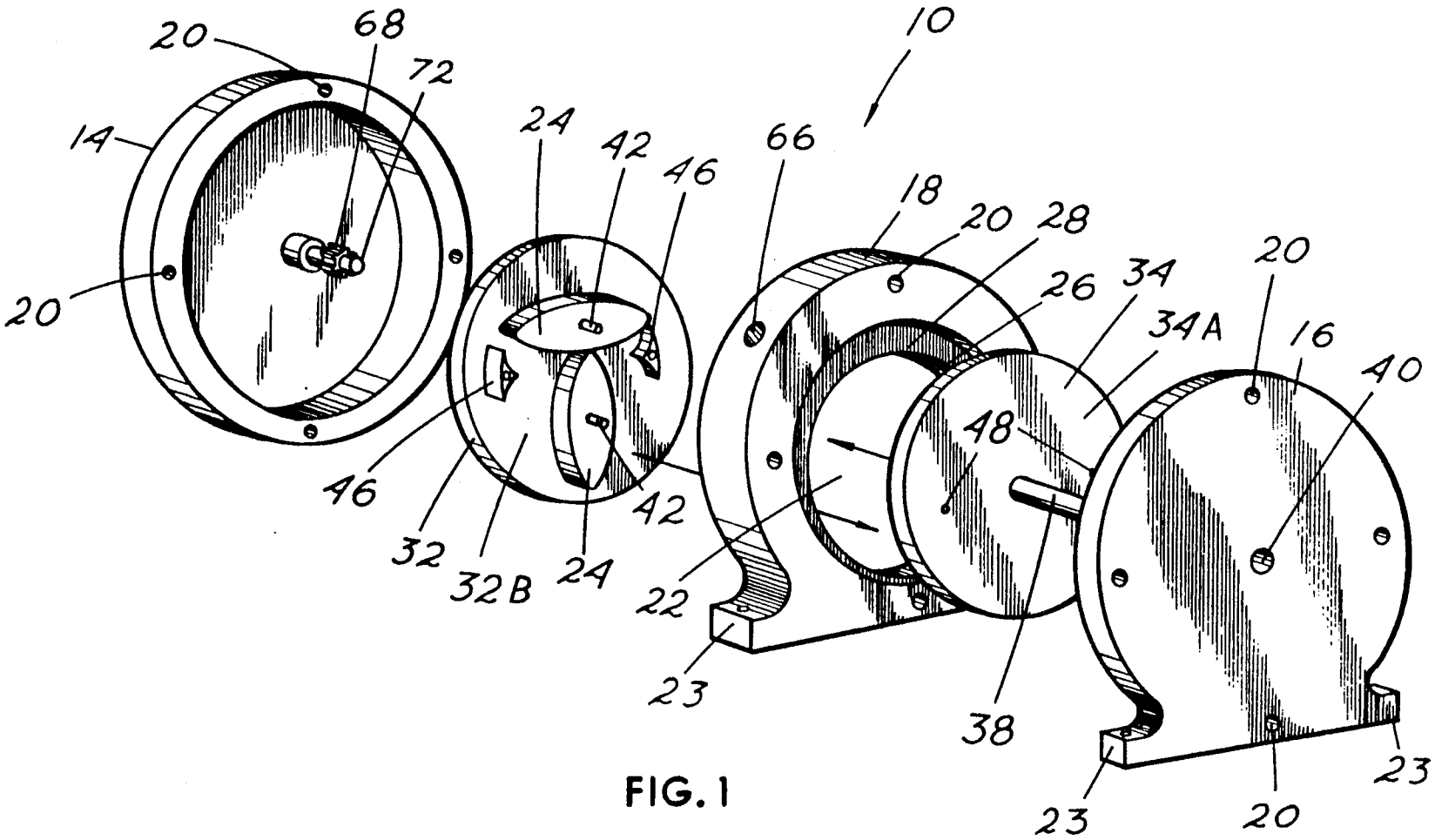
FIG. 1 is an exploded front perspective view of one structural example of the invention.
Figure 5:
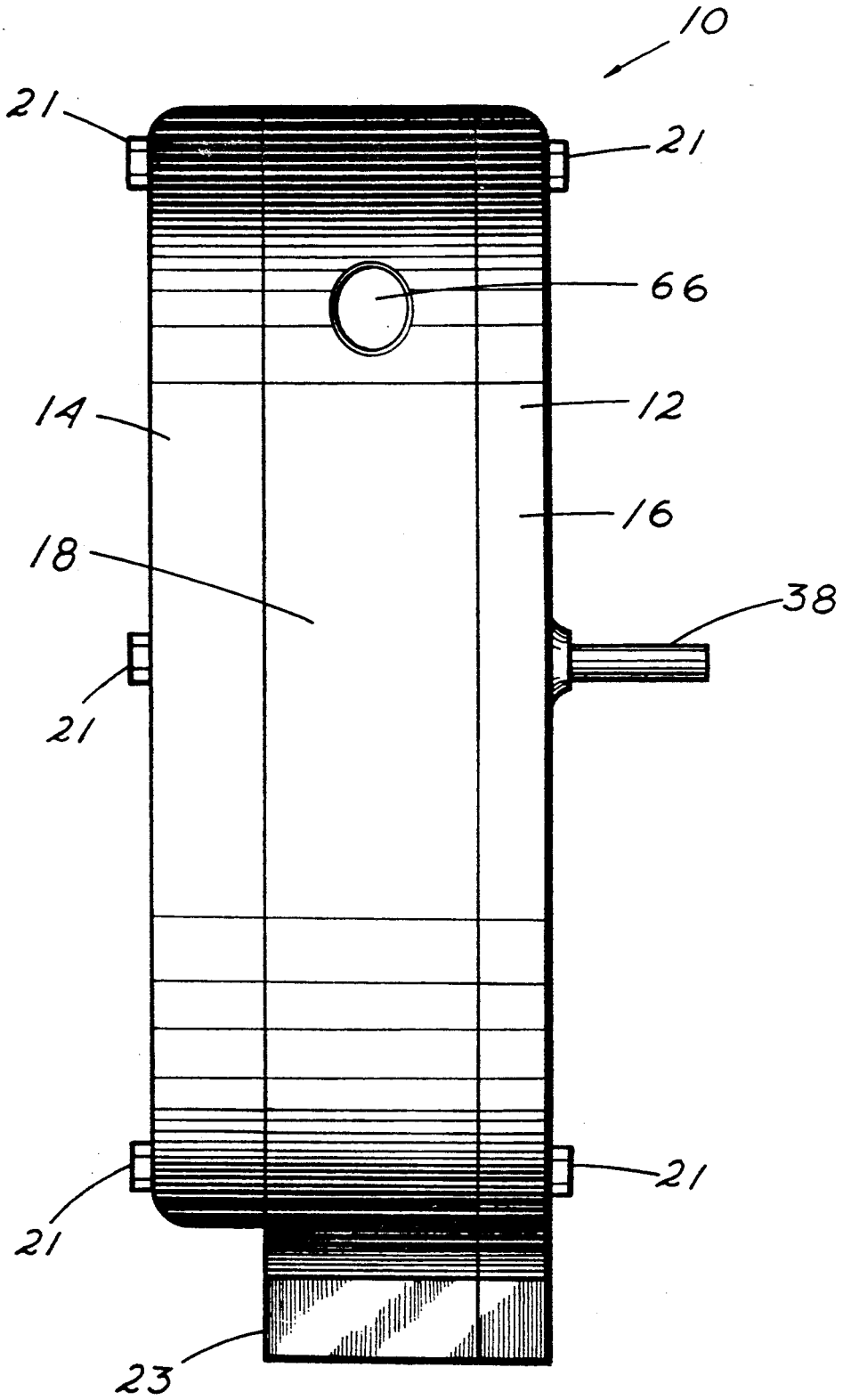
FIG. 5 is a side view of the assembled example of the invention of FIG. 1.
Figure 6:
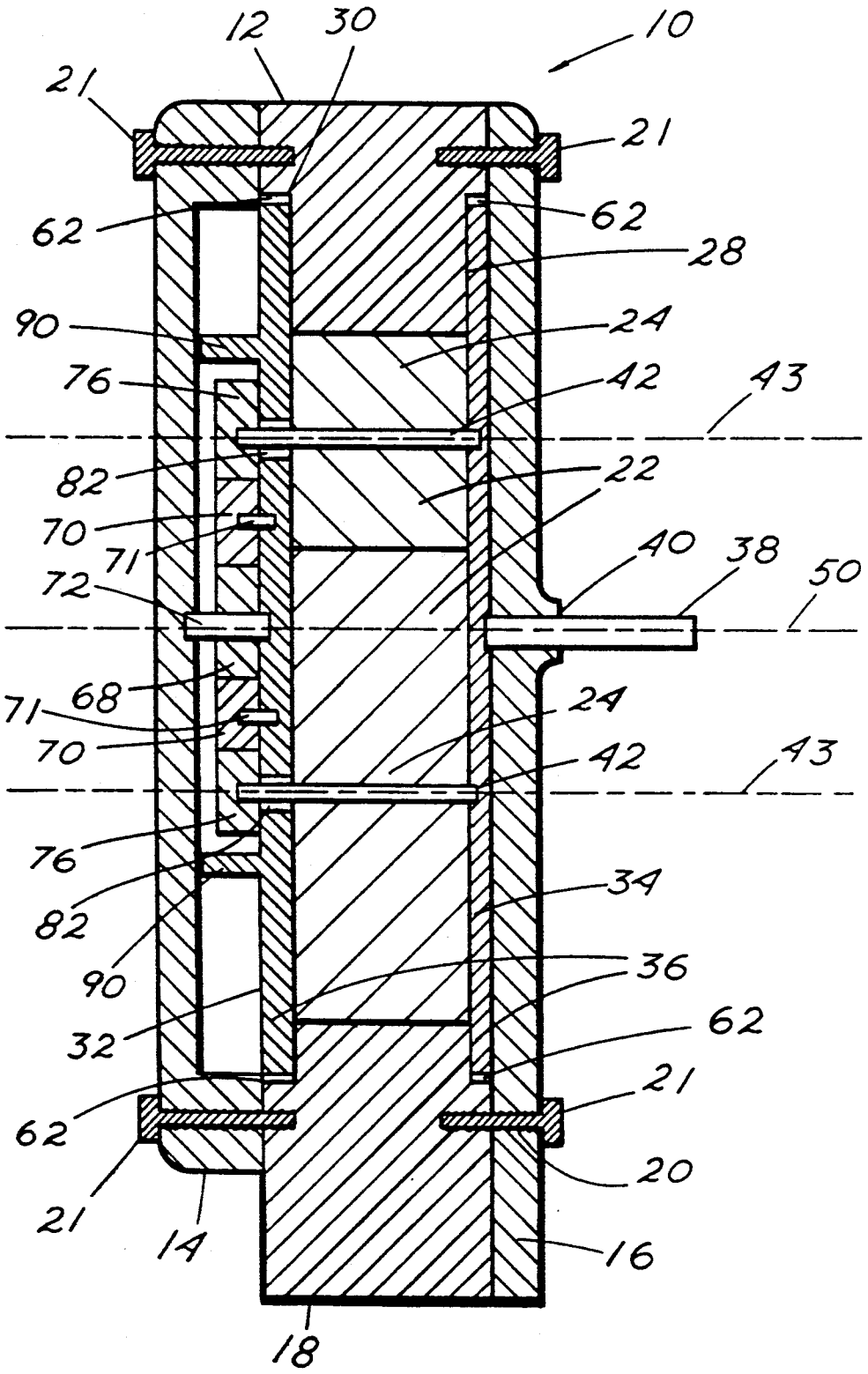
FIG. 6 is cross-sectional side view of the assembled example of the invention of FIG. 1.

In the partially exploded view of embodiment 10 in FIG. 1, a housing desirably made of substantially rigid materials such metal or plastic is shown parted into three sections. The three sections of the housing allow assembly, disassembly and servicing of the apparatus. The housing may of course be parted in different locations and in different numbers of sections. The three housing sections of embodiment 10 are designated end plate 14, end plate 16, and main housing section 18. Each of the three housing sections contain alignable bolt apertures 20, some of which may be internally threaded, and some of which may be unthreaded apertures to allow the application of bolts 21 and the retaining of the three housing sections together as shown in FIG. 5 and 6. The assembled housing of embodiment 10, designated housing 12, preferably also has outwardly extending apertured feet 23 to allow bolting the apparatus to flooring for stability during use. A fluid input port 64 and an output port 66 are shown extending through main housing section 18 into main chamber 22, and will be further discussed later.

Figure 2:
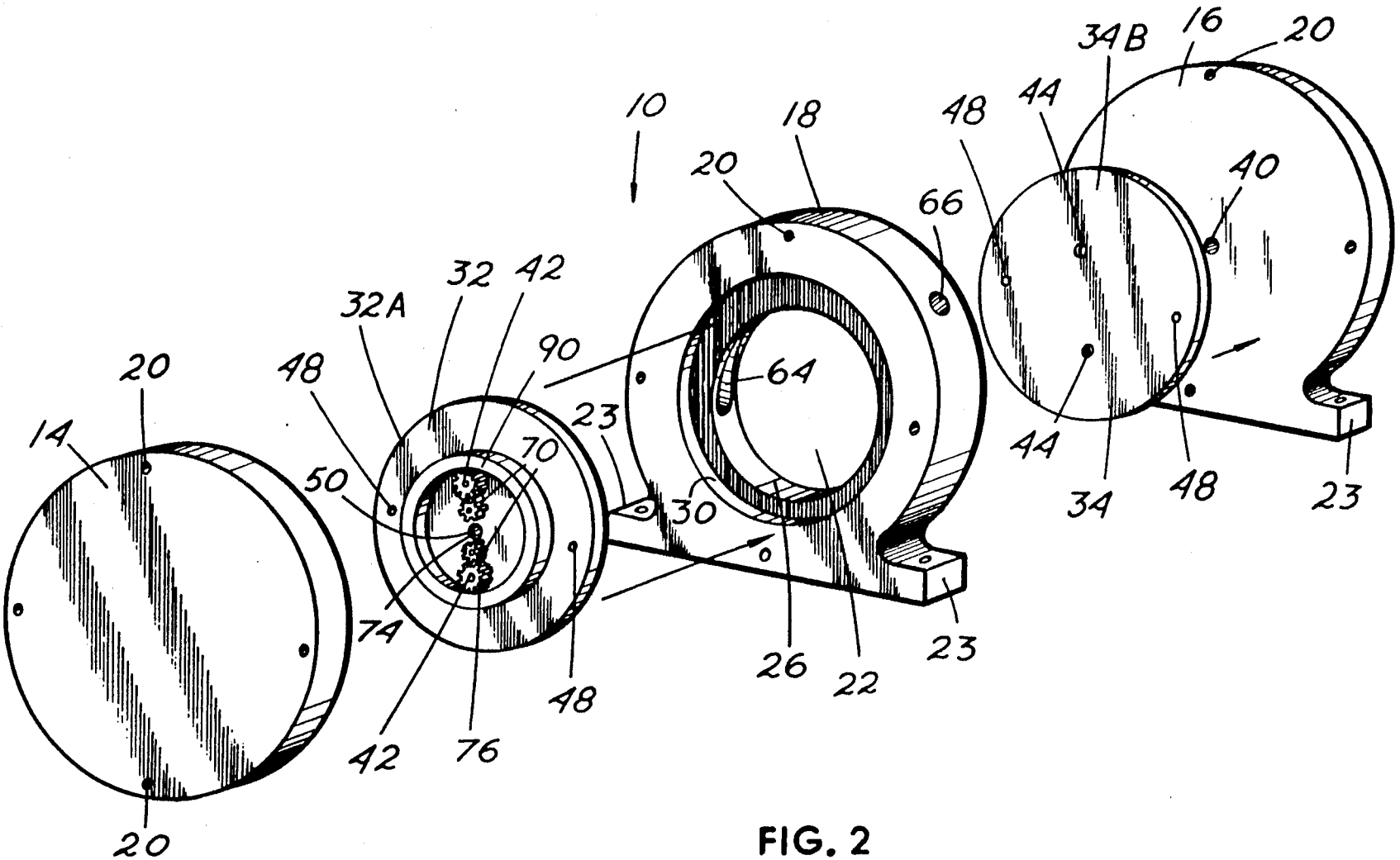
FIG. 2 is an exploded rear perspective view of the example of the invention of FIG. 1.
Figure 3:
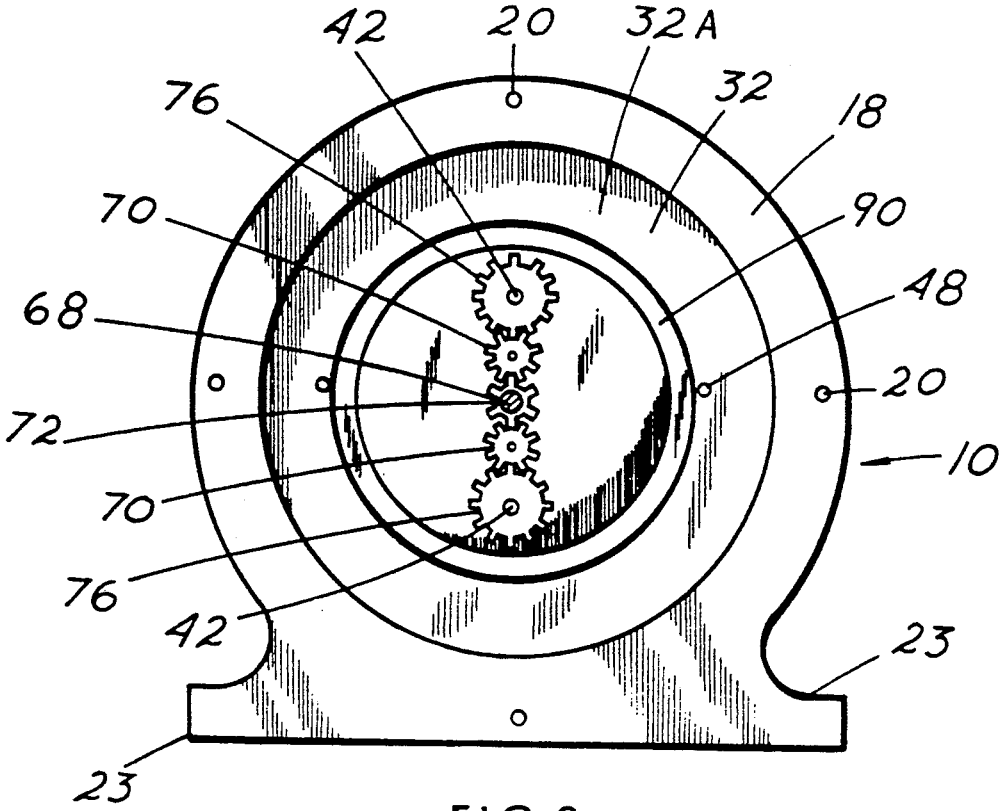
FIG. 3 is a rear view of the example of the invention of FIG. 1 partially assembled. Gearing used as part of a transmission and timing assembly are also shown.

Housing 12 contains an interior, cylindrically shaped main chamber 22 primarily defined within main housing section 18 by an interior annular sidewall 26 surrounding main chamber 22. Interior annular sidewall 26 may be a perfect circle, or may be slightly out of round, providing clearance or other means is allowed to provide for rotational movement of blades 24 and the seal blocks 46 within main chamber 22. As shown in FIG. 1 and 2, at the ends of main housing section 18, adjacent the outer edges of annular sidewall 26 are circular recesses 28 and 30 each desirably of equal diameter. The circumferal edges of both circular recesses 28 and 30 are aligned with each other, but separated by a portion of main housing section 18 as shown in the drawings. Recesses 28 and 30 are positioned eccentric with main chamber 22 and annular sidewall 26 as may be ascertained from FIG. 1 and 2.

Shown in FIG. 1 and 2 are two rotatable plate-like members made of either substantially rigid metal or plastic material, and designated hub member 32 and hub member 34. Hub members 32 and 34 when affixed in a stationary relationship to each other form the main portion of rotatable carriage assembly 36 shown assembled in FIG. 6. Hub member 32 is sized to fit rotatably within circular recess 30, and hub member 34 is sized to fit rotatably within circular recess 28. A space is left for blades 24 between the two hub members when affixed in recesses 28 and 30. This "space" in essence is main chamber 22. The diameter of each hub member 32 and 34 is sized slightly smaller than the internal diameter of the respective recesses 28 and 30 into which they fit, in order to provide sufficient clearance to allow rotation of the hubs 32 and 34. Additional clearance between hub members 32 and 34, and recesses 28 and 30 may also be provided for the insertion of radial fluid seals 62 shown in FIG. 6 which prevent the escape of fluid from main chamber 22. The surfaces of each hub member 32 and 34 which face inward into main chamber 22, designated 32 B and 34 B, are preferably flat to allow sufficient fluid sealing between surfaces 32 B and 34 B and the ends of blades 24 as the blades 24 ride in at least a close proximity to the hub members. Hub members 32 and 34 in this example of the invention essentially define the end walls of the cylindrically shaped main chamber 22.

Figure 4:
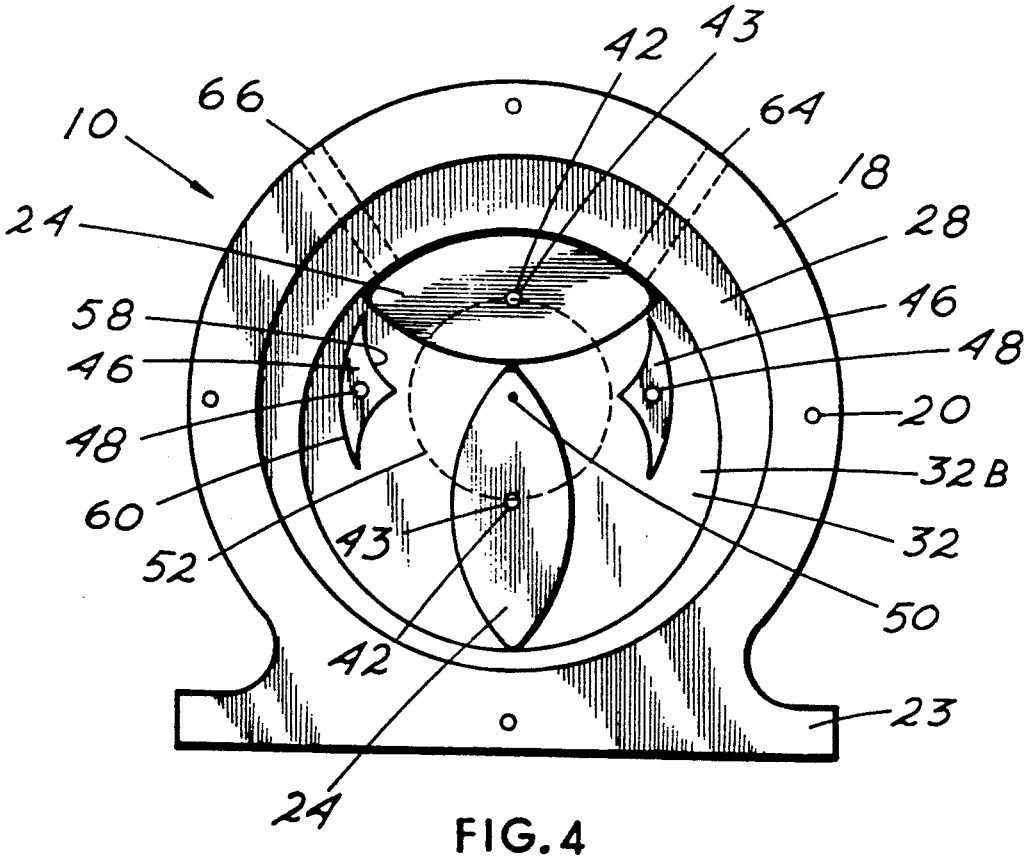
FIG. 4 is a front view of the example of the invention of FIG. 1 partially assembled.

In embodiment 10, the flat surface of hub member 32, designated 32 B, has the two essentially identical rigid blades 24 rotatably affixed thereto. Blades 24 may be made of any rigid material including metal, plastic, and composite materials, or as will be discussed later, may be made of flexible materials. Each blade 24 is attached to hub member 32 by one rotatable axle 42 per blade 24 placed preferably through the precise center of each blade. In FIG. 6, the rotational axes of blades 24 are shown with dotted lines numbered 43. Each blade 24 is attached in a fix relationship to an axle 42 to rotate with the axle. Each axle 42 passes through hub 32 to the back side thereof, designated 32 A. Axles 42 are rotatably retained to hub member 32. Operational gearing on hub side 32 A which drive and maintain timing of axles 42 will be explained later. As shown in FIG. 1, 4, and 6, the opposite end of axles 42 extend beyond the end of each blade 24, and extend outward toward hub member 34. As shown in FIG. 2, surface 34 B of hub member 34 contains two cylindrical bores or recesses 44 which do not necessarily pass completely through hub member 34. Each of the recesses 44 loosely receives one axle end so as to allow stabilized rotation of axles 42 therein. Recesses 44 may contain friction reducing bushings or bearings.

Referring now to FIG. 1, 3, 4, and 6 to further explain the assemblage and affixment of carriage assembly 36 within housing 12. Attached to surface 32 B of hub member 32 are two seal blocks 46. Seal blocks 46 are positioned and affixed stationary on hub member 32 at about the maximum rotating reach of blades 24, and present a convenient location through which to extend a bolt or bolts to fasten hub members 32 and 34 together with blades 24 and seal blocks 46 sandwiched therebetween. Although seal blocks 46 and blades 24 should all be about the same thickness, that is, extending outward from hub member 32 toward hub member 34, seal blocks 46 should be just slightly thicker than blades 24 to allow tight sandwiching of seal block 46 between hub members 32 and 34, without blades 24 being prevented from rotating with axles 42. Each hub member 32 and 34 has two bolt holes 48 therethrough, and each seal block 46 has a bolt hole therethrough also numbered 48 in FIG. 4 to allow fastening the assemblage together by passing a bolt through each bolt hole 48. In order to maintain each seal block 46 stationary in relationship to hub members 32 and 34, that is, to prevent the seal blocks from rotating around a single mounting bolt, two or more bolt holes 48, and two or more bolts may be used for each seal block 46. Seal blocks 46 may be formed as an integral piece of one of the hub members 32 or 34, although other methods such as welding, adhesive bonding or screws may of course be used to affix the seal blocks stationary between hub members 32 and 34. Additional information on seal blocks 46 will be given later.

Affixed to the center of hub member 34 on surface 34 A at rotational axis 50 of carriage assembly 36, is a rigid metal main shaft 38 extending straight outward from hub member 34. With embodiment 10 assembled, main shaft 38 passes through shaft aperture 40 in end plate 16 to extend to the exterior of embodiment 10. Shaft aperture 40 is sized relative to main shaft 38 to allow rotation of shaft 38 therein. Shaft aperture 40 is preferably formed at least in part with a close fitting friction reducing bearing or bushing to further stabilize shaft 38 and carriage assembly 36, and to add durability to the apparatus. End plate 16 is primarily utilized to assist in stabilizing shaft 38 and carriage assemblage 36 in the assembled embodiment 10.

Figure 7A:
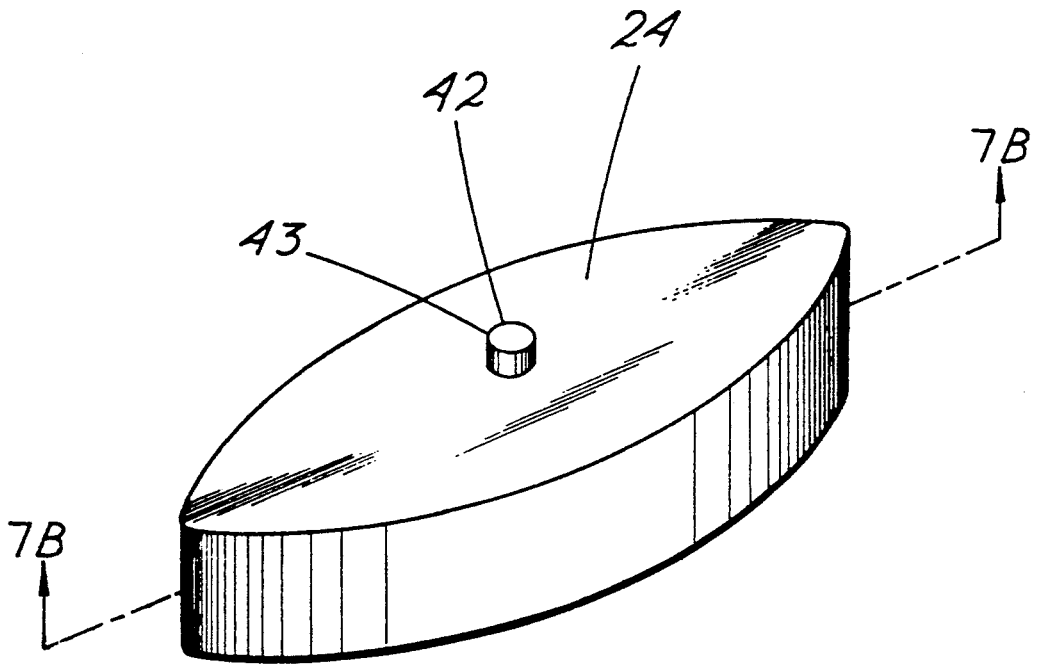
FIG. 7A illustrates a blade utilized as part of the invention in an end perspective view.
Figure 7B:
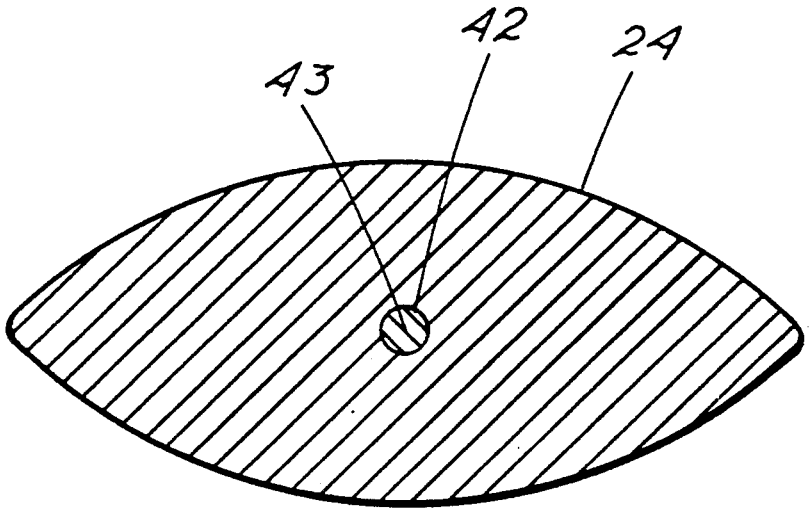
FIG. 7B is a cross-sectional profile of a single blade.
Figure 8I:
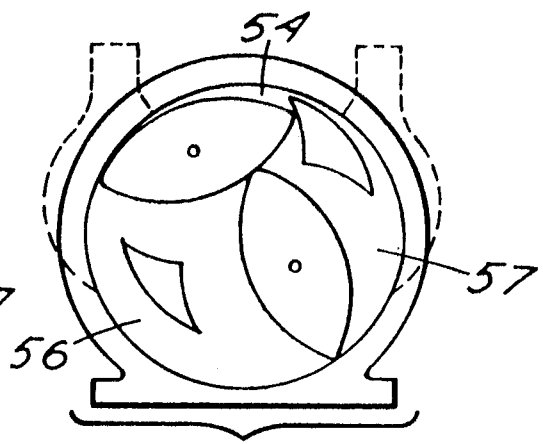
Figure 8H:
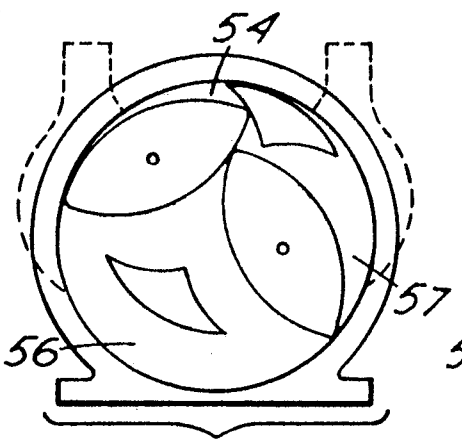
Figure 8G:
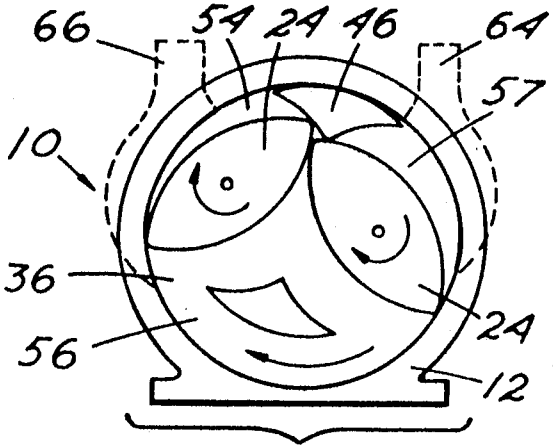
Figure 8K:
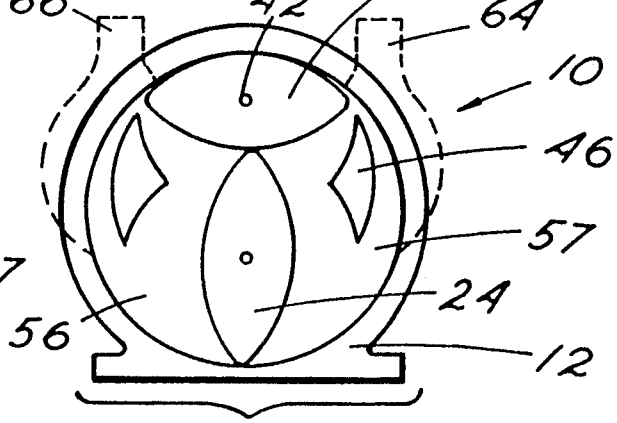
Figure 8J:
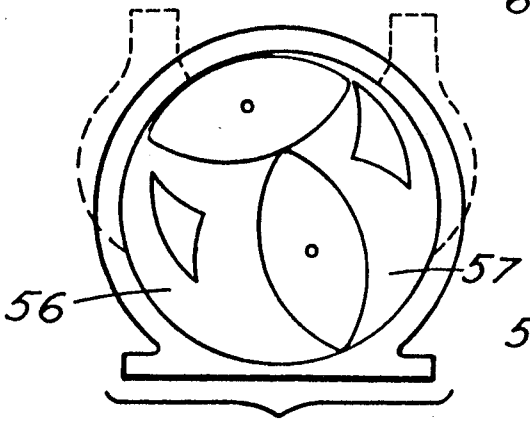
Figure 9:
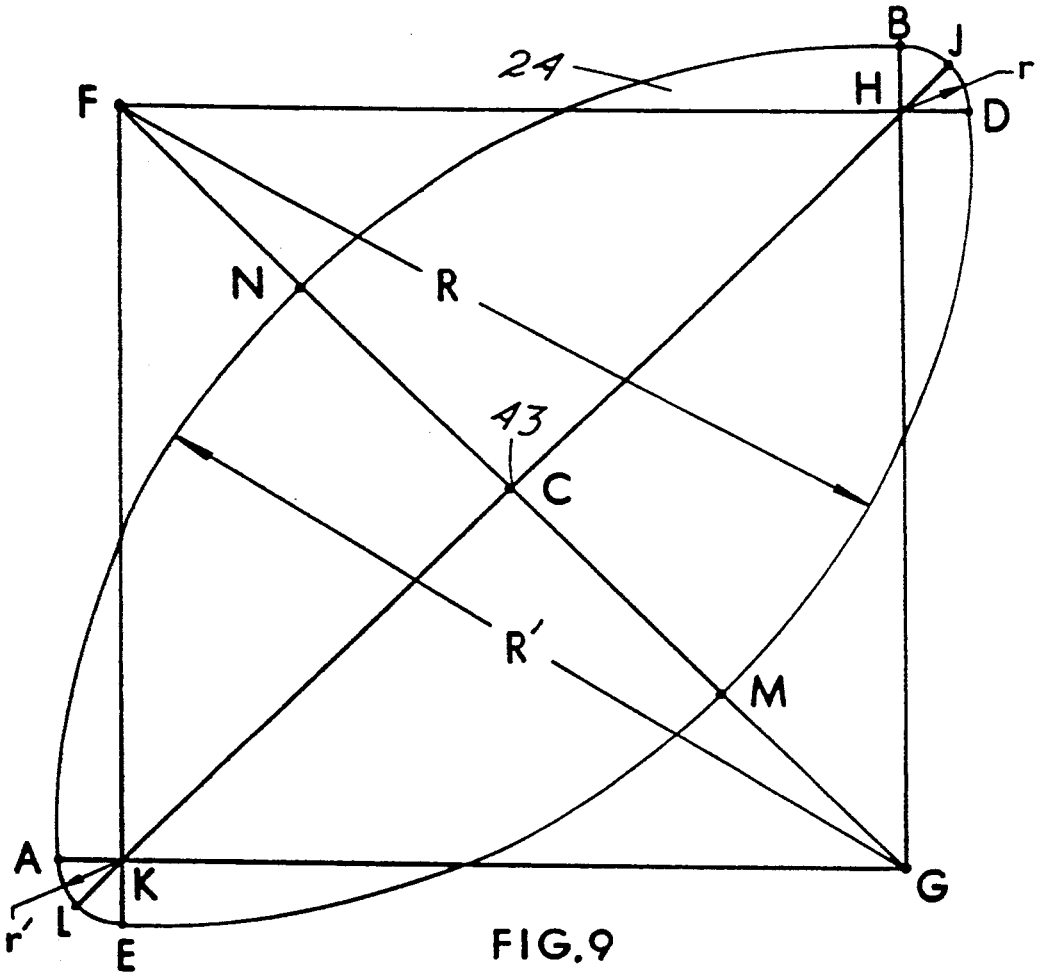
FIG. 9 geometrically illustrates the preferred cross-sectional profile of the blades utilized as part of the invention.

As shown in the drawings, particularly FIG. 7 B, each blade 24 is oval in cross-sectional profile. FIG. 9 is illustrative of a mathematically ideal cross-sectional profile of a blade 24, geometrically demonstrated with the use of a reference square formed of corner points F, H, G, and K. The preferred cross-sectional profile of each blade 24 is two opposing equal larger radius 90 degree arcs each with the same radius (R=R'), and designated arcs AB and DE. Arcs AB and DE are joined at the endpoints by two opposing equal smaller radius 90 degree arcs each with the same radius (r=r'), and designated arcs EA and BD. The value of the smaller radius (r) arcs should be substantially less than the value of the larger radius (R) arcs in order to form the elongated cross-sectional profile. Line NM is shown passing through the center or rotational axis designated point C of the blade 24. Line NM is the breadthwise axis of the ideal cross-sectional blade 24 profile. Breadthwise axis NM is also the shortest distance through point C from arc AB to arc DE. Line JL is the longitudinal axis of the ideal cross-sectional profile of blade 24, is perpendicular to line NM, and is the longest distance through point C between the narrow ends of the cross-sectional profile. Lines NM and JL intersect at point C, with point C being the ideal blade 24 profile center. Lines NM and JL extend radially outward from rotational axis 43 or point C of blade 24.

Figure 10:
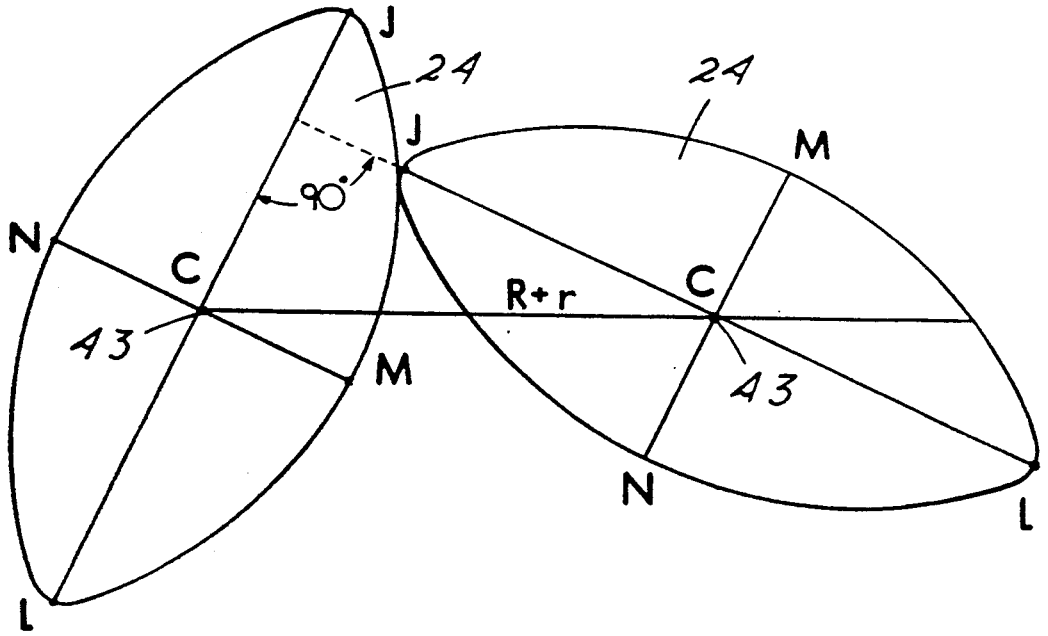
FIG. 10 illustrates the geometrical relationship of the two blade profiles that maintain a point of approximate contact while rotating in the same direction at the same velocity during operation of the apparatus.

It can be shown as depicted in FIG. 8 and 10, that if two identical ideal profile blades 24 are placed with rotational axes 43 or points C spaced apart a distance equal to the sum of one larger radius (R) arc plus one smaller radius (r) arc, and the longitudinal axis JL of one blade 24 profile is positioned perpendicular to the longitudinal axis JL of the other blade 24 profile, that the blade 24 profiles will have a point of tangency or contact. For example, if the value of the larger radius arc (R) equals five inches, and the value of the smaller radius arc (r) equals one-forth of an inch, then the spacing between the two center points C as shown in FIG. 10 would be five and one-forth inches when using rigid blades 24. (FIG. 10 is not drawn to scale.) It follows that if these blade 24 profiles are rotated about the blade rotational axes 43 in the same direction and angular velocity so as to maintain perpendicularity, a point of tangency or contact will be maintained. In the invention, it is this point of approximate contact between the two blades 24 which forms a moving fluid seal or barrier between the two blades 24 during operation. The point of tangency or contact in the structure may or may not be "absolute" contact at all times, but may best be described as blades 24 being in at least a close proximity to tangency or contact. The maintained close proximity to contact of one blade 24 to the other should be sufficiently close to form a reasonably effective fluid seal or barrier between the two blades 24. The desired degree of closeness between the two blades 24 may in large part be determined by the viscosity and consistency of the fluid desired to be moved, and the size of the apparatus. For example; the degree of close proximity to contact of one blade 24 to the other when moving thick and heavy crude oil through a main chamber 22 which is ten feet in diameter is far less critical than when moving gasoline or air which are much less viscus than crude oil. The degree of close proximity to contact of one blade 24 to the other will of course effect the overall fluid moving efficiency of the invention, and therefore in most cases, the closer to actual contact between blades 24 the better, as long as an excessive amount of friction is not developed. However, in some circumstances a small amount of space between the two rigid blades 24 may be desirable, such as when pumping water from a creek where small particles of sand may be moved through the apparatus, and it might be wise to allow some space between the blades 24 to possibly allow some of the sand to pass therebetween, hopefully eliminating the possibility of excessive wear and binding of blades 24 against each other. The reasoning for the terms "close proximity to contact" is also applicable to the placement of blades 24 relative to interior annular sidewall 26 and hub members 32 and 34 as will be better understood by a continued reading.

In the structural example of the invention shown in embodiment 10, axles 42 are affixed to hub members 32 and 34 equal distant outward from rotational axis 50 of carriage assembly 36. Rotational axis 50 of carriage assembly 36 is eccentrically placed relative to the center of main chamber 22 and interior annular sidewall 26. In theory, rotational axis 50 extends in parallel alignment with interior annular sidewall 26 through main chamber 22. Axles 42 are positioned to be in the same orbit circle about rotational axis 50 during operation of the apparatus. The rotational axes 43 of blades 24 in theory extend in parallel alignment with each other, and further, in parallel alignment with both rotational axis 50 of carriage assembly 36, and interior annular sidewall 26. In drawing FIG. 4, the orbit circle of axles 42 is demonstrated using a dotted line designated with the number 52. Orbit circle 52 is eccentrically placed relative to the center of main chamber 22 and interior annular sidewall 26, and concentric with rotational axis 50 of carriage assembly 36. Axles 42 are positioned in orbit circle 52 as close as is feasibly possible to being 180 degrees apart from one another.

The profile or diameter of main chamber 22 between interior annular sidewall 26 is primarily determined by the size of rotating blades 24 affixed properly in position to carriage assembly 36 with the cross-sectional longitudinal axis of one blade 24 affixed perpendicular to the cross-sectional longitudinal axis of the other blade 24. The diameter of interior annular sidewall 26 is essentially determined by the outermost sweep of blades 24 as they rotate with axles 42 and orbit about rotational axis 50 of rotating carriage assembly 36. As may be ascertained with an examination of drawing FIG. 8 A through 8 K which illustrate one-half revolution of carriage assembly 36 and one-quarter revolution of each blade 24 about the blade rotational axis 43, a point of each blade 24 is maintained in at least a close proximity to contact with interior annular sidewall 26, thereby forming a moving fluid seal between each blade 24 and interior annular sidewall 26 simultaneously with the two blades 24 being in at least a close proximity to contact with each other.

A brief discussion of seal blocks will now ensue. Seal blocks 46 are affixed to each be in the same orbital path as the other, and 180 degrees apart from each other about rotational axis 50 of carriage assembly 36, and further to be approximately 90 degrees apart from axles 42. Each seal block 46 is positioned at about the maximum sweeping reach of the rotating blades 24. During operation, the orbital path of seal blocks 46 is eccentric with interior annular sidewall 26 of main chamber 22. Seal blocks 46 provide additional fluid boundaries as the shapes thereof are maximized to a shape that contacts or nearly contacts blades 24 and interior annular sidewall 26 periodically during operation of embodiment 10. The shape of seal blocks 46 is preferably approximately the shape of three arcs affixed together as shown in FIG. 4. Two of the arcs of each of seal block 46, designated arcs 58, are both concave, and nominally have a radius of roughly one-half the length of the cross-sectional longitudinal axis JL of a blade 24. Arcs 58 are positioned so as to intermittently form fluid seals or barriers between the arcuate sweep of the narrowed ends of blades 24. The remaining arc of each seal block 46, being convex arc 60 which faces interior annular sidewall 26, desirably has a radius of approximately the distance from rotational axis 50 to the closest point of interior annular sidewall 26. During operation, arc 60 sweeps toward interior annular sidewall 26 to form a fluid seal or barrier to assist in forming fluid moving sub-chambers within main chamber 22 best seen in FIG. 8 A through 8 K. It should be noted seal blocks 46 could be of different shapes from that shown and described, and could also be made of flexible and resilient materials to allow changing of the arc radiuses for improved fluid sealing when pressure is applied thereto, such as by interior annular sidewall 26 or blades 24 pressing thereagainst.

As may be further ascertained from the drawings, the positioning of blades 24 and seal blocks 46 divide main chamber 22 into sub-chambers 54 and 56, and periodically, a third sub-chamber 57. In FIG. 8 A, sub-chambers 54 and 56 begin equal in size or volume, and sub-chamber 57 does not yet exist. The upper blade 24 is shown positioned lengthwise horizontally disposed above the lower blade 24 which is positioned lengthwise vertically disposed. The somewhat parallel alignment of the one 90 degree larger arc of the horizontally disposed blade 24 relative to interior annular sidewall 26 should be noted. Also in FIG. 8 A, direction arrows are shown to illustrate the direction of rotation of both blades 24 and carriage assembly 36 as being clockwise. In FIG. 8 B, sub-chambers 54 and 56 have begun to both change in volume and rotate clockwise. In FIG. 8 C, sub-chamber 54 has contracted in volume, sub-chamber 56 has expanded in volume, and sub-chamber 57 has begun to form and expand. In FIG. 8 D, sub-chamber 54 has further contracted, and both sub-chambers 56 and 57 have further expanded. Sub-chambers 54, 56, and 57 are also rotating clockwise as time progresses. In FIG. 8 F, sub-chamber 54 has further contracted, sub-chamber 56 has reached a maximum volume, and sub-chamber 57 has further expanded. In FIG. 8 G through 8 I, sub-chamber 54 and sub-chamber 56 have both contracted, and sub-chamber 57 has further expanded. In FIG. 8 J, sub-chamber 54 has disappeared or merged with the still expanding sub-chamber 57, and sub-chamber 56 has further contracted. In FIG. 8 K, two equal volume sub-chambers again exist.

The relative placement of one blade 24 to the other blade 24, of both blades 24 to seal blocks 46, and of blades 24 and seal blocks 46 to interior annular sidewall 26 and fluid input and output ports 64 and 66 during operation is quite important. The relative placement of these components must be initially properly set, and the moving components must be maintained in a properly synchronized relationship during operation in order for the apparatus to function at optimum efficiency.

A mechanical transmission and timing arrangement is utilized to link or communicate rotation in blades 24 to rotation in carriage assembly 36, or link rotation in carriage assembly 36 to rotation in the blades 24. During operation, the mechanical transmission and timing arrangement also maintains proper directional rotation and timing. Both blades 24 and carriage assembly 36 may rotate in either a clockwise or counterclockwise rotation as long as the components are rotating in the same direction during operation. While blades 24 orbit about rotational axis 50 of the rotating carriage assembly 36, each blade 24 rotates in the same direction about blade 24 rotational axis 43 as the other blade 24, and at a rate equal to one-half revolution per one full revolution of the rotating carriage assembly 36. The transmission and timing arrangement shown for example in embodiment 10 is structured using a center non-rotating or stationary gear 68. Stationary gear 68 is shown in FIG. 1 affixed stationary to the interior side of end plate 14 with a shaft 72. Upon assemblage, the center of stationary gear 68 is supported at rotational axis 50 of carriage assembly 36 with shaft 72 extending from the center of gear 68 inserted into a recess 74 in hub member 32. The fit between shaft 72 and recess 74 is sufficiently loose to allow carriage assembly 36 to rotate about shaft 72. Recess 74 may also use a friction reducing bushing or bearing for added durability. Stationary gear 68 is affixed between and meshes with two rotatable idler gears 70 shown in FIG. 2 and 3. Idler gears 70 are attached rotatably by axles 71 affixed to side 32 A of hub member 32. Idler gears 70 in turn mesh with two blade drive gears 76 positioned on side 32 A. Each blade drive gear 76 is attached in a fixed relationship to one of the rotatable axles 42. Each blade drive gear 76 has twice the number of teeth as stationary gear 68 in order to provide the proper gear ratio. If rotational force is applied to carriage assembly 36 causing the assembly 36 to rotate around stationary gear 68, idler gears 70 are forced to rotate, which in turn cause blade drive gears 76 to rotate thus rotating blades 24. The example of gears being used in embodiment 10 is just one of many useful transmission and timing arrangements such as sprockets and chains, or timing belts and pulleys which could be used with the invention to achieve the same end result of linking movement between blades 24 and carriage assembly 36, and provide timing where one revolution of carriage assembly 36 equals one-half revolution of each blade 24.

Also shown in FIG. 2 is an annular ring 90 on hub member 32 which serves to define an area which could be packed with a heavy gear-lubricating grease. Annular ring 90 may have a removable cover (not shown), or may extend outward to abut the interior side of end plate 14 when housing 12 is assembled, with this abutment assisting in both retaining the grease and in further stabilizing carriage assembly 36.

Figure 11:
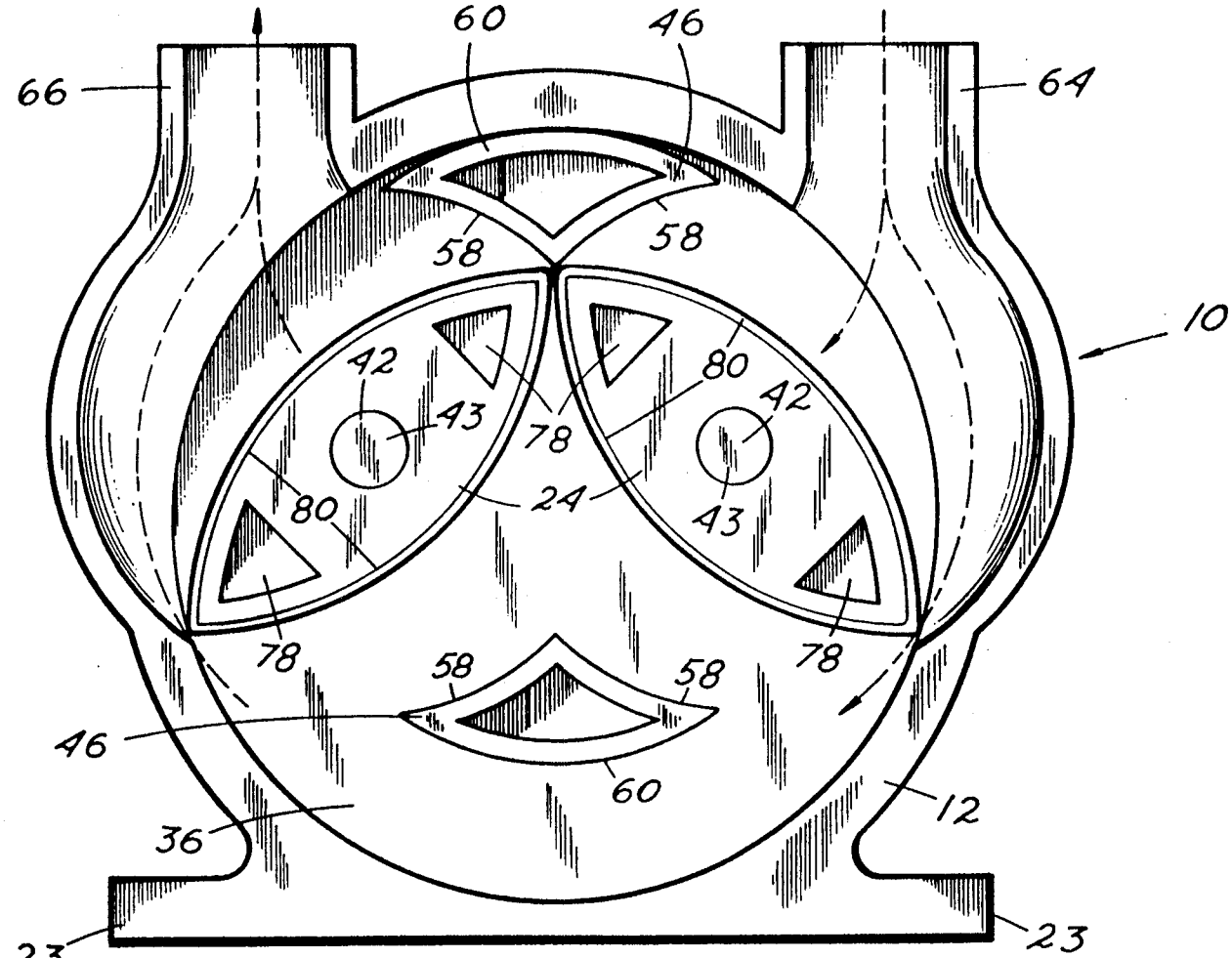
FIG. 11 illustrates one suitable fluid input and output porting arrangement, and flexible resilient blades and seal blocks.

Referring now mainly to FIG. 8 A through 8 K, and FIG. 11 to further explain fluid input port 64 and output port 66. Both ports 64 and 66 extend through housing 12 into main chamber 22. The upper or exterior ends of ports 64 and 66 opening through the exterior of housing 12 may be structured with pipe threads or other suitable structures to allow the attachment of hoses or piping to provide for the inputting and exhausting of a liquid or gas into embodiment 10. The lower or interior end of fluid input port 64 terminates in open communication with expanding sub-chambers within main chamber 22, and the lower end of fluid output port 66 terminates in open communication with the contracting sub-chambers within main chamber 22.

Since liquids are generally non-compressible, a contracting sub-chamber full of liquid should always be in communication with a fluid port, preferably fluid output port 66 or the apparatus will jam and cease to rotate. FIG. 11 shows one suitable positioning for input and output ports 64 and 66 when liquids are being displaced with embodiment 10. In FIG. 11, blades 24 are shown defining a sub-chamber 56 having reached the maximum size, which with further rotation would become a contracting sub-chamber. If this maximum sized sub-chamber 56 were filled with liquid, due to the shown placement of output port 66, further clockwise rotation of carriage assembly 36 and blades 24 would begin to exhaust the liquid through fluid output port 66. The entrances of fluid input port 64 and output port 66 into main chamber 22 may be elongated to allow exhausting fluid from two contracting sub-chambers at once, and to allow inputting fluid into two expanding sub-chambers at once as may be ascertained by again examining FIGS. 8 A through 8 K. In FIG. 2, in the center of housing main section 18, the elongated entrance of input port 64 into chamber 22 may be seen.

The porting arrangement for compressible gases is less critical than for non-compressible liquids since a compressible gas will generally not lock-up the rotating components in a momentary absence of an exit port in communication with a gas filled contracting sub-chamber. The actual placement of fluid input port 64 and output port 66 can be varied somewhat for that shown in FIG. 11, and will in all likelihood be somewhat different when embodiment 10 is exclusively built to be used to displace gases rather than liquids.

Although not shown in the drawings, it is anticipated that fluid input port 64 and output port 66 may actually extend through end plates 14 or 16 rather than main housing section 18. With fluid input port 64 and output port 66 extending through end plates 14 or 16, apertures through one of the rotating hub members 32 or 34 would periodically align with input port 64 and output port 66 extending through one of the housing end plates to form an open fluid conduit in communication with sub-chambers within main chamber 22. The formation of the open fluid conduits in communication with the sub-chambers would of course have to be properly timed to coordinate fluid port exposure at the right moment of sub-chamber formation within main chamber 22.

Also shown in FIG. 11 are blades 24 made of flexible and resilient plastic material such as polypropylene for example. Apertures 78 are formed through the narrowed end of each blade 24 adjacent each smaller radius of blades 24. Apertures 78 provide a space into which the flexible and resilient plastic material which forms the smaller radius wall may be pressed back into in order to allow deformation of the blade 24 tip. This flexible blade 24 structuring allows the building of blades 24 of a length which provides constant engagement under pressure of one blade 24 against the other, and constant engagement of both blades 24 under pressure against interior annular sidewall 26 for improved fluid sealing and separation of the sub-chambers 54, 56, and 57. Also shown in FIG. 11 are hollow, deformable seal blocks 46 made of flexible and resilient plastic material such as polypropylene for example. Seal block 46 made of flexible and resilient materials would allow for improved fluid sealing between a seal block 46 and interior annular sidewall 26. This principle of improved fluid sealing using flexible components may also be achieved by actually building interior annular sidewall 26 with a degree of flexibility and resiliency to allow either rigid or flexible blades 24 or seal blocks 46 to fit tighter thereagainst for improved sealing.

Since the invention may be used either as a pressure driven motor, a fluid pump, a steam engine, or even possibly an internal combustion engine, adequate sealing between certain parts under most conditions will be important. To use embodiment 10 as a fluid pump capable of lifting liquid with suction, or build pressure when pumping, main chamber 22 must be adequately sealed to prevent the inadvertent influx and outflow of fluid under pressure or the loss of vacuum. Carefully machined components and close tolerance fits of the components will achieve adequate sealing in some cases. In other cases, flexibility and resiliency in blades 24, seal blocks 46, and or interior annular sidewall 26 will help in some of the areas which need improved sealing. As briefly described above, radial seals 62 affixed within recesses 28 and 30 against which hub members 32 and 34 ride will prevent the influx and outflow of fluid under pressure or the loss of vacuum through leakage around the outer edges of hub members 32 and 34. Radial seals 62 and other shaft seals are available in a variety of materials and shapes from several U.S. manufacturers such as Bal Seal Engineering Company, Inc., located at 6220 West Warner Ave., Santa Ana, Calif. Other U.S. companies can also supply proper fluid seals. Other locations in embodiment 10 which may need to have attention given to proper sealing are around each axle 42 where they pass through hub member 32. Shaft seals 82 are shown around axles 42 in FIG. 6. Another location is on the end surfaces of blades 24 which ride against hub members 32 and 34. As shown in FIG. 11, flexible and resilient fluid sealing material 80 shown as a narrow strip may be adhered to each end of blades 24 which ride against hub members 32 and 34 to improve the separation between the sub-chambers, or the same result could be achieved by adhering rubbery sealing material to surfaces 32 B and 34 B of hub members 32 and 34. It should be noted that many different fluid sealing principles and structures have been developed over the years which are well known to those skill in the art. Some of the known seals which may be used in any desired place in any of the various embodiments of the invention include moveable spring biased seals, pressure energized seals, both of which may be utilized at the narrowed ends of blades 24, and packing type seals to name just a few.

Referring now to FIG. 12 where embodiment 11 is shown. Embodiment 11 is structured slightly different than embodiment 10, and operates on very similar principles with similar structuring. The primary difference of embodiment 11 and embodiment 10 is in the housing 12 structure and the size and placement therein of hub members 32 and 34. Housing 12 of embodiment 11 is shown made of only two sections, section 84 and 86. In embodiment 11, recess 28 is in housing section 84, and recess 30 is in housing section 86. Hub members 32 and 34 are comparatively substantially diametrically smaller than hub members 32 and 34 of embodiment 10. In embodiment 11, hub members 32 and 34 form only a portion of the main chamber 22 end walls as opposed to hub members 32 and 34 of embodiment 10 which primarily form the entire end walls of main chamber 22 therein. In embodiment 11, a portion of the main chamber 22 end walls against which blades 24 ride and seal are formed by stationary portions of housing sections 84 and 86. The structure of embodiment 11 as compared to embodiment 10 allows for smaller diameter hub members 32 and 34 relative to the diameter of main chamber 22. The smaller diameter of hub members 32 and 34 in embodiment 11 allows for a decrease in velocity of the outer edges of hub members 32 and 34 against radial seals 62 with main shaft 38 rotating at a given rate, as compared to that of the outer edges of hub members 32 and 34 of embodiment 10. It is this reduction of velocity of hub members 32 and 34 of embodiment 11 which is anticipated to increase the efficiency and functional life of radial seals 62 if used. It should be noted that known and available face type fluid seals be may used instead of radial seals 62 in the invention.

Figure 13:
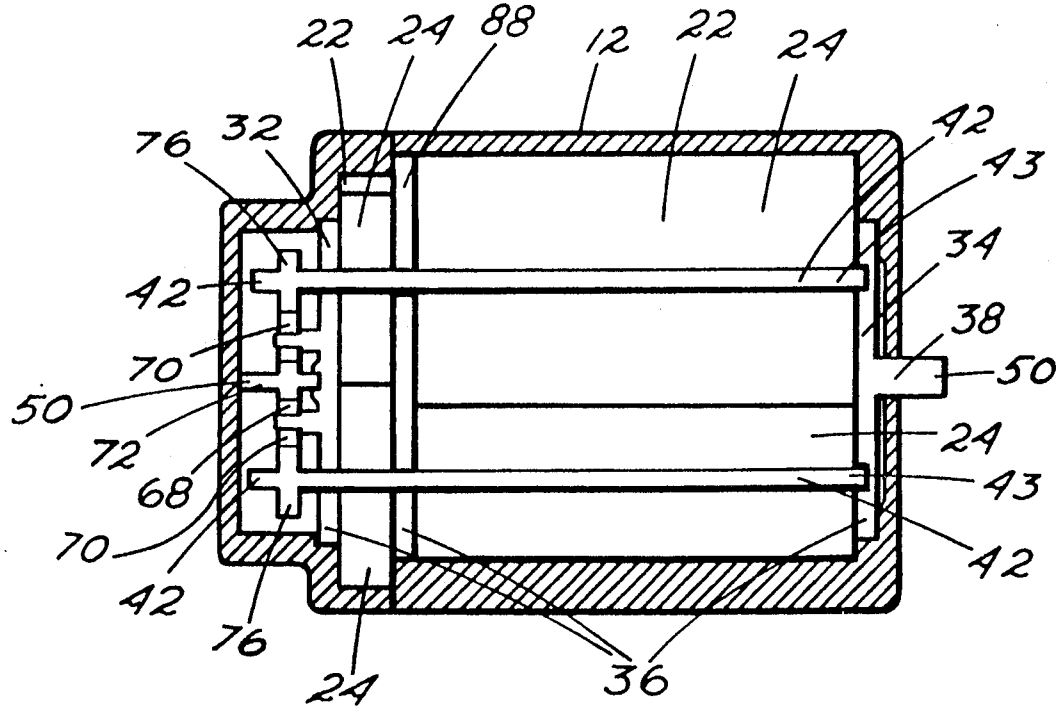
FIG. 13 illustrates a "ganged" or multi-chambered embodiment of the invention.

Referring now to drawing FIG. 13 which helps to illustrate it is possible for the invention to be ganged, where a single carriage assembly 36 having hub members 32, 34, and at least one additional hub member 88, only two blade axles 42, and two or more main chambers 22 each containing a pair of blades 24 are utilized in a single structure. The ganged arrangement shown in FIG. 13 may be structured and used to form a compounding or two-stage gas compressor for example, or possibly for using gravity feed water supplied under pressure into one chamber 22 to rotate carriage assembly 36, in which case the other chamber 22 could be used to pump a gas or liquid. FIG. 13 also shows that the size of main chambers 22 and the lengths of blades 24 between the hub members can be varied for different applications.

For simplicity, all movement described so far is relative to a stationary main chamber 22 and interior annular sidewall 26, where a rotating carriage assembly 36 carries axles 42, blades 24, and seal blocks 46 in an orbital path eccentric with sidewall 26. The orbital path provided by rotating carriage assembly 36 sweeps axles 42, blades 24, and seal blocks 46 towards and then away from interior annular sidewall 26. However, although not shown in the drawings, it should be noted that it is well within the scope of the invention to place both axles 42 and seal blocks 46 stationary and eccentrically within main chamber 22, and rotate interior annular sidewall 26 about a point that is eccentric to annular sidewall 26. The point which interior annular sidewall 26 would rotate would be a point centered midway on a straight line drawn between the rotational axes 43 of blades 24 (rotational axis 50 in embodiment 10). Rotation of interior annular sidewall 26 about stationary axles 42, seal blocks 46, and rotating blades 24, would sweep interior annular sidewall 26 towards and away from axles 42, rotating blades 24, and seal blocks 46. With a rotating interior annular sidewall 26, and stationary eccentrically affixed axles 42 and seal blocks 46, it is possible to create expanding and contracting sub-chambers much the same as is shown in the FIG. 8 A through 8 k drawings pertaining to embodiment 10, providing that one full revolution of interior annular sidewall 26 equals one-half revolution of blades 24 with axles 42.

Although I have very specifically described the invention in detail, it should be understood that the specific details are just examples given for the benefit of those skilled in the art. Many changes in the specific structures described and shown may obviously be made without departing from the scope of the invention, and therefore it should be understood that the scope of the invention is not to be limited by the specification and drawings given for example, but is to be determined by the spirit and scope of the appended claims.

What I claim as my invention is:

1. A rotary fluid displacement apparatus comprising a chamber containing two rotatable blades, each said blade having a cross-sectional profile approximating opposing generally equal larger radius 90 degree arcs connected by opposing generally equal smaller radius 90 degree arcs, each said rotatable blade positioned with a cross-sectional longitudinal axis of one said blade affixed and maintained generally perpendicular to a cross-sectional longitudinal axis of the other said blade, a portion of each said blade further maintained in at least a close proximity to contacting the other said blade, a portion of each said blade further positioned in at least a close proximity to contacting an interior annular wall partially bounding said chamber, said apparatus having means to rotate said blades within said chamber to form expanding and contracting sub-chambers within said chamber, at least one fluid input port into said chamber, and at least one fluid output port into said chamber.

2. A rotary fluid displacement apparatus having two axially rotating blades within a chamber, said chamber at least partially defined by an annular sidewall, a rotational axis of each said rotating blade placed eccentrically to a center point of said chamber, each said rotating blade having a generally oval cross-sectional profile, a cross-sectional longitudinal axis of one said rotating blade affixed and maintained generally perpendicular to a cross-sectional longitudinal axis of the other said rotating blade, each of said rotating blades placed and maintained in at least a close proximity to contact with the other said rotating blade, at least one fluid input port into said chamber, at least one fluid output port into said chamber, said apparatus having means providing relative movement between said annular sidewall and said rotational axes of said rotating blades with said relative movement moving said rotational axes of said rotating blades towards and then away from said annular sidewall thereby positioning a portion of each of said rotating blades in at least a close proximity to contact with said annular sidewall, timing means coordinating said relative movement between said annular sidewall and said rotational axes of said rotating blades.

3. An apparatus according to claim 2 wherein each said blade has a said cross-sectional profile approximating opposing generally equal larger radius 90 degree arcs connected by opposing generally equal smaller radius 90 degree arcs.

4. An apparatus according to claim 2 wherein said means providing relative movement between said annular sidewall and said rotational axes of said rotating blades includes said rotating blades attached to a rotating carriage means, with said rotating carriage means positioned eccentrically within said chamber.

5. A rotary fluid displacement apparatus operational by cyclically building expanding and contracting fluid-moving sub-chambers within a main chamber, said apparatus comprising;

a housing having at least one said main chamber therein, an interior annular sidewall of said housing at least partially bounding said main chamber;

a rotatable carriage means at least partially in communication with said main chamber, a rotational axis of said carriage means extending eccentrically through said main chamber;

a first blade and a second blade positioned within said main chamber, each of said blades rotatably attached at a generally central point of said blades to said carriage means by at least one axle per said blade, a rotational axis of each said blade being generally parallel to said rotational axis of said carriage means, said axles of each said blade positioned to be in a generally coinciding orbital path about said rotational axis of said carriage means and about 180 degrees apart in said orbital path, each said blade having a generally oval cross-sectional profile, a cross-sectional longitudinal axis of one said blade affixed and maintained generally perpendicular to a cross-sectional longitudinal axis of the other said blade, each of said blades placed and maintained in at least a close proximity to contact with the other said blade;

a portion of each of said blades positioned in at least a close proximity to contact with said interior annular sidewall;

transmission means having means to communicate rotational movement between said carriage means and said blades;

timing means having means to maintain a relationship of one revolution of said carriage means equaling about one-half revolution of each said blade about said rotational axis of each said blade;

at least one fluid input port through said housing in communication with said main chamber;

at least one fluid output port through said housing in communication with said main chamber;

6. An apparatus according to claim 5 wherein each said blade has a said cross-sectional profile approximating opposing generally equal larger radius 90 degree arcs connected by opposing generally equal smaller radius 90 degree arcs.

* * * * *